US011172286B2

(12) United States Patent
Bai et al.

(10) Patent No.: US 11,172,286 B2
(45) Date of Patent: Nov. 9, 2021

(54) EARPHONE COVER AND EARPHONE HAVING THE SAME

(71) Applicant: Anker Innovations Technology Co., Ltd., Changsha (CN)

(72) Inventors: Xuefeng Bai, Changsha (CN); Hongchao Zhou, Changsha (CN)

(73) Assignee: Anker Innovations Technology Co., Ltd., Changsha (CN)

( * ) Notice: Subject to any disclaimer, the term of this patent is extended or adjusted under 35 U.S.C. 154(b) by 371 days.

(21) Appl. No.: 16/328,281

(22) PCT Filed: Feb. 9, 2017

(86) PCT No.: PCT/CN2017/073143
§ 371 (c)(1),
(2) Date: Feb. 25, 2019

(87) PCT Pub. No.: WO2018/058878
PCT Pub. Date: Apr. 5, 2018

(65) Prior Publication Data

US 2021/0297766 A1 Sep. 23, 2021

(30) Foreign Application Priority Data

Sep. 27, 2016 (CN) ..... 201610854098.6

(51) Int. Cl.
*H04R 25/00* (2006.01)
*H04R 1/10* (2006.01)

(52) U.S. Cl.
CPC ..... *H04R 1/1091* (2013.01)

(58) Field of Classification Search
CPC .. H04R 1/1025; H04R 13/6205; H04R 1/105; H04R 2201/107; H04R 2420/07;
(Continued)

(56) References Cited

U.S. PATENT DOCUMENTS

| | | | | |
|---|---|---|---|---|
| 9,398,365 | B2 | 7/2016 | Liu | |
| 10,034,078 | B2 * | 7/2018 | Silvestri | H04R 1/1091 |
| 2009/0041284 | A1 * | 2/2009 | Tanaka | H04R 1/1016 381/370 |

FOREIGN PATENT DOCUMENTS

| | | | |
|---|---|---|---|
| CN | 105392080 | A | 3/2016 |
| EP | 3240298 | A1 | 1/2017 |

(Continued)

OTHER PUBLICATIONS

JP 2019-504927; Office Action, dated Feb. 20, 2020; 4 pages of English Translation, 5 pages Original Issue.

(Continued)

*Primary Examiner* — Amir H Etesam
(74) *Attorney, Agent, or Firm* — Banner & Witcoff, Ltd.

(57) ABSTRACT

The present invention relates to an earphone cover and an earphone having the same. The earphone cover is used to be placed on the earphone, comprising a sleeve portion and a fixing portion for setting the earphone cover on the earphone. The fixing portion encloses the sleeve portion, and the sleeve portion penetrates the fixing portion. The fixing portion includes a first end portion and a second end portion opposite to the first end portion. When the earphone cover is built in the human ear, the first end portion and the second end portion are in contact with the ear bone to form at least three setting points. Thus, after the earphone cover is set on the earphone, the earphone cover and the ear bone form three fixed points when the earphone is fixed in the ear, then the earphone may be firmly fixed in the ear bone through the three fixed points, and hence is not easy to fall off.

18 Claims, 5 Drawing Sheets

(58) Field of Classification Search
CPC ..... H04R 2420/09; H04R 1/1016; H04R 1/1066; H04R 5/033; H04R 11/02; H04R 5/04; H04R 1/26
See application file for complete search history.

(56) References Cited

FOREIGN PATENT DOCUMENTS

| | | | |
|---|---|---|---|
| EP | 3528507 | A1 | 2/2017 |
| JP | 2006222492 | A | 8/2006 |
| JP | 2009044429 | A | 2/2009 |

OTHER PUBLICATIONS

Yasuichi "Yen Earphones with an enhanced feeling of wearing"; Avpress, Nihon, Inc.; Jun. 15, 2012; Online: <URL: https://av.watch.impress.co.jp/docs/news/540442.html>, URL, https://av.watch.impress.co.jp/docs/news/540442.html.
EP17854339.3, Extended European Search Report dated Mar. 26, 2020, 9 pages.
EP17854339.3, European Supplementary Search Report dated Apr. 16, 2020, 9 pages.

* cited by examiner

EARPHONE COVER AND EARPHONE HAVING THE SAME

TECHNICAL FIELD

The present invention relates to the field of earphone accessories, in particular, to an earphone cover and an earphone having the same.

BACKGROUND

At present, most electronic products such as mobile phones, tablets, etc. have music or sound effects, which requires the use of earphones, and most of the earphones are wired. These wired earphones need to be inserted into the human ear during use. However, when people are exercising, the earphones are easily detached from the human ear, causing inconvenience to people.

In addition, the contact area of the cavitas conchae and the skull is thin and the most fragile, so the general earphone is easy to cause damage here.

SUMMARY

In view of this, it is necessary to provide an earphone cover and an earphone using the cover to solve the above problem.

To achieve the above object, the present invention provides the following technical solution:

The present invention provides an earphone cover used to be placed on the earphone, comprising a sleeve portion and a fixing portion, for setting the earphone cover on the earphone. The fixing portion encloses the sleeve portion, and the sleeve portion penetrates the fixing portion. The fixing portion includes a first end portion and a second end portion opposite to the first end portion. When the earphone cover is built in the human ear, the first end portion and the second end portion are in contact with the ear bone to form at least three setting points.

In some embodiments, the fixing portion has an egg shape, and a spherical radius of the first end portion is larger than a spherical radius of the second end portion.

In some embodiments, the second end portion includes an upper portion corresponding to the crus helix and a lower portion corresponding to the cavitas conchae; when the second end is snapped on an antitragus of the ear bone, the upper portion forms at least one snapping point with the crus helix, and the lower portion forms at least one snapping point with the cavitas conchae.

In some embodiments, the first end portion is formed on the tragus of the ear bone to form at least one snapping point.

In some embodiments, the fixing portion is provided with a cavity, and the sleeve portion is connected with the cavity thoroughly; when the fixing portion is built into the human ear, the fixing portion is deformed to discharge the gas in the cavity from the sleeve portion.

In some embodiments, the fixing portion includes a front side facing the inside of the ear and a rear side facing the opposite of the front side; the sleeve portion has a larger aperture on the front side than that on the rear side, so that when the earphone cover is disposed on the earphone, a gap is formed between the earphone cover and the earphone.

In some embodiments, the first end portion or/and the second end portion are provided with a through hole, and the through hole is deformed when the first end portion or/and the second end portion is snapped in the ear bone to enable the earphone cover to expand and contract.

In some embodiments, the through hole has a crescent shape.

In some embodiments, the fixing portion is made of silica gel.

Further, in order to achieve the above object, the present invention further provides an earphone. The earphone comprises an earplug cap, a front case, a rear case and an earphone cover. The earplug cap is set on one end of the front case. The front case cooperates with the rear case to form a sound chamber and a cavity for accommodating other circuit components of the earphone. The earphone cover is set on the front case. Wherein the earphone cover is the one in any of above items.

For the earplug cap, the front case, the rear case and the earphone cover, the front case includes a speaker therein; the earplug cap is set on the speaker; the front case cooperates with the rear case and are provided with a cavity for accommodating other circuit components of the earphone and forming a sound chamber; the earphone cover is set on the front case and adjacent to the earplug cap. Wherein the earphone cover is the one in any one of above items.

The beneficial effects of the present invention are that after the earphone sleeve is set in the earphone earpiece, the earphone earpiece is firmly snapped in the ear bone by the three fixed points formed by the earphone cover and the earphone earpiece, so that the earphone may be fastened in the ear bone and is not easy to fall off.

Figure 1:
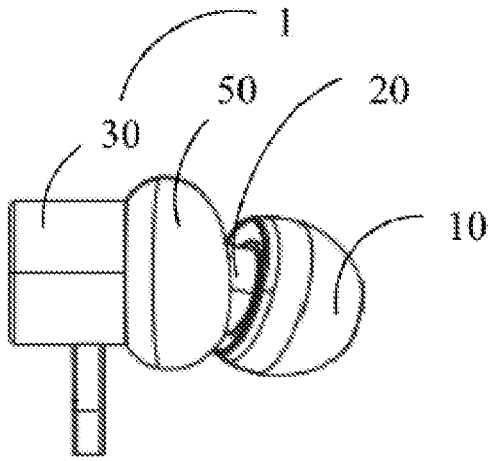
FIG. 1 is a view of an earphone in a first specific embodiment of the present invention.

| Reference numerals | |
|---|---|
| Earphone | 1 |
| Earphone plug | 10 |
| Front case | 20 |
| Rear case | 30 |
| Earphone cover | 50 |
| Sleeve portion | 51 |
| Fixing portion | 52 |
| First end portion | 521 |
| Second end portion | 522 |
| Front side | 523 |
| Rear side | 524 |
| Top | 525 |
| Bottom | 526 |
| Gap | 527 |
| Cavity | 528 |
| Through hole | 529 |

-continued

| Reference numerals | |
|---|---|
| Human ear | 100 |
| Ear bone | 110 |
| Tragus | 111 |
| Antitragus | 112 |

The present invention is further described below with reference to the drawings.

DETAILED DESCRIPTION OF THE EMBODIMENTS

In order that the objectives, technical schemes and advantages of the present invention will become more apparent, the present invention will be described in more detail with reference to the drawings and examples above. It should be understood that the specific embodiments described herein are only for illustrating but not for limiting the present invention.

Furthermore, technical features involved in each embodiment of the present invention described as below could be combined as long as they don't contradict with each other.

Figure 2:
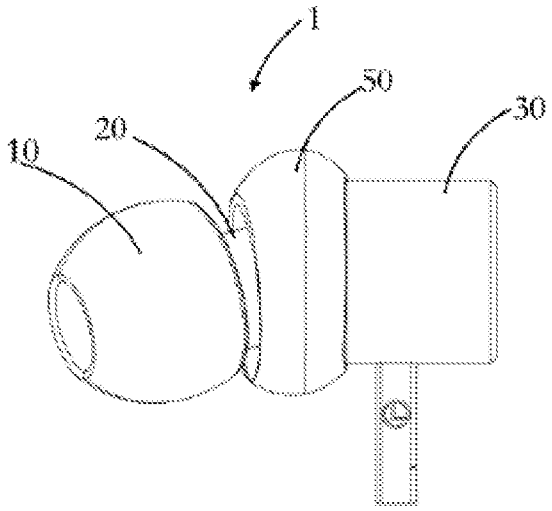
FIG. 2 is a view of the earphone shown in FIG. 1 in another viewing angle state.

With reference to FIGS. 1 and 2, a view of an earphone 1 in a first specific embodiment of the present invention is illustrated. In the present embodiment, the earphone 1 is an in-ear earphone. The earphone 1 comprises an earplug cap 10, a front case 20, a rear case 30 and an earphone cover 50. Among them, the earplug cap 10 is set on one end of the front case 20, the front case 20 cooperating with the rear case 30 to form a sound chamber and a cavity for accommodating other circuit components of the earphone.

Figure 3:
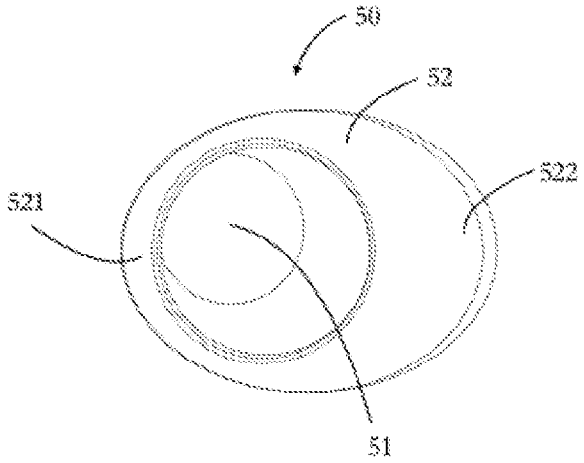
FIG. 3 is a view of the earphone cover shown in FIG. 1 in a first state.
Figure 4:
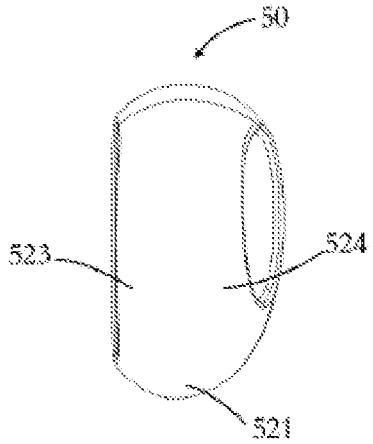
FIG. 4 is a view of the earphone cover shown in FIG. 1 in a second state.

With reference to FIGS. 3 and 4, a view of the earphone cover 50 in the present embodiment is illustrated. The earphone cover 50 includes a sleeve portion 51 and a fixing portion 52. The sleeve portion 51 is configured to set the earphone cover 50 on the front case 20. The fixing portion 52 surrounds the sleeve portion 51. The sleeve portion 51 extends through the fixing portion 52. The fixing portion 52 includes a first end portion 521 and a second end portion 522 opposite to the first end portion 521. Preferably, a spherical radius of the first end portion 521 is larger than a spherical radius of the second end portion 522. Specifically, the fixing portion 52 has an egg shape. The distance between the sleeve portion 51 and the first end portion 521 is smaller than the distance between it and the second end portion 522. The sleeve portion 51 further includes a front side 523 and a rear side 524 opposite to the front side 523. Among them, the front side 523 faces the earplug cap 10, i.e., toward the ear; the rear side 524 faces the rear case 30. In the present embodiment, the aperture of the sleeve portion 51 on the front side 523 is larger than the aperture of the sleeve portion 51 on the rear side 524 and larger than the maximum diameter of the body of the front case 20. Therefore, when the earphone cover 50 is set on the front case 20, there is a certain gap 527 between the earphone cover 50 and the front case 20 (see FIG. 6).

Figure 7:
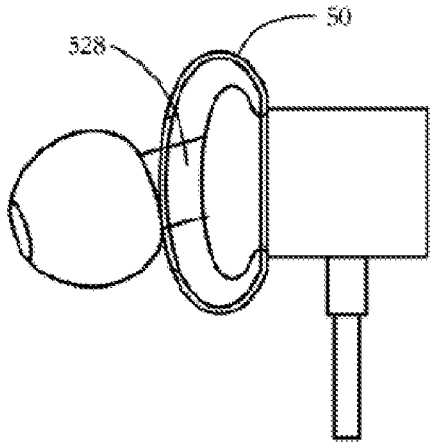
FIG. 7 is a section view of FIG. 6.

With reference to FIG. 7, in the present embodiment, the fixing portion 52 is provided with a hollow cavity 528. The cavity 528 is connected with the sleeve portion 51 thoroughly. The earphone cover 50 is made of a soft material such as elastic silica gel.

Figure 5:
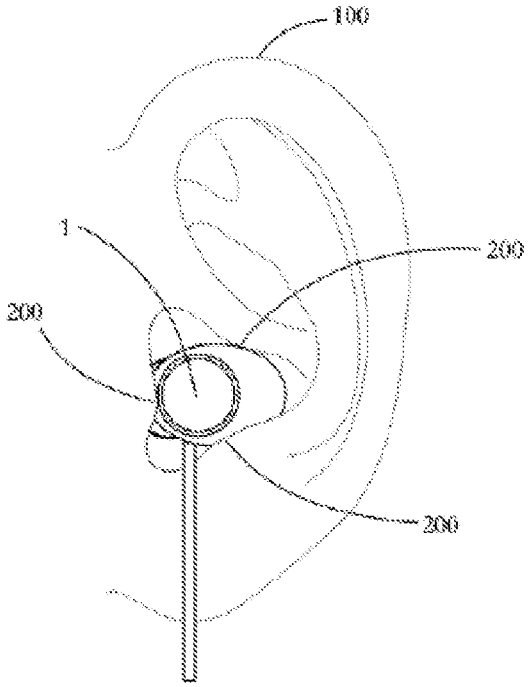
FIG. 5 is a view of the earphone in use state in a first embodiment of the present invention.
Figure 6:
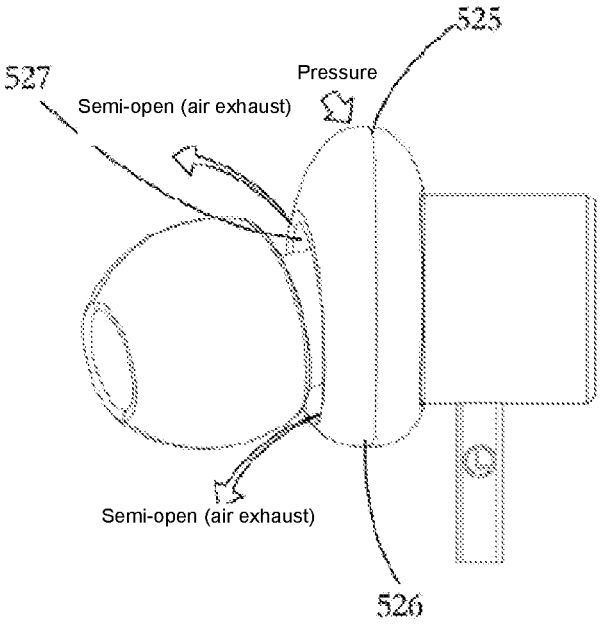
FIG. 6 is a view of the force applied to the earphone cover shown in FIG. 5.

With reference to FIG. 5, a view of the earphone 1 in use state in a third embodiment of the present invention is illustrated. With reference to FIG. 6 together, a section view of the earphone 1 in use state in a third embodiment of the present invention is illustrated. When the earphone 1 is inserted into the user's ear 100, the earphone cover 50 abuts the ear bone 110. Specifically, the front side 523 of the earphone cover 50 abuts the ear bone 110 such that the front side 523 is forced to deform toward the rear side 524, while the first end portion 521 and the second end portion 522 are snapped onto the ear bone 110. Specifically, the ear bone 110 includes a tragus 111 and an antitragus 112, and the first end portion 521 abuts the tragus 111; the second end portion 522 abuts the antitragus 112. Moreover, the second end portion 522 and the ear bone 110 may form at least two snapping points 200. Specifically, the second end portion 522 includes an upper portion corresponding to a crus helix and a lower portion corresponding to a cavitas conchae; when the second end portion 522 is snapped on the ear bone 110, the upper portion forms at least one snapping point 220 with the crus helix, and the lower portion forms at least one snapping point 200 with the cavitas conchae. At the same time, the first end portion 521 is also snapped on the ear bone 110 to form at least one snapping points 200, i.e., the first end portion 521 may form a snapping point 200 at the tragus. When the top 525 and the bottom 526 of the earphone cover 50 abut against the ear bone 110, the air in the cavity 528 is squeezed out of the gap 527. Therefore, the earphone cover 50 may be adjusted in shape according to the pressure (i.e., the longitudinal distance of the user's cavitas conchae). Thus, the earphone cover 50 may be applied to multiple users.

Furthermore, with at least three snapping points formed, the earphone cover 50 secures the earphone 1 to the ear bone 110 so that the earphone 1 may not fall off easily. In addition, the earphone 1 is more closely fitted to the human ear 100, and the possibility of sound leakage is greatly reduced.

Figure 8:
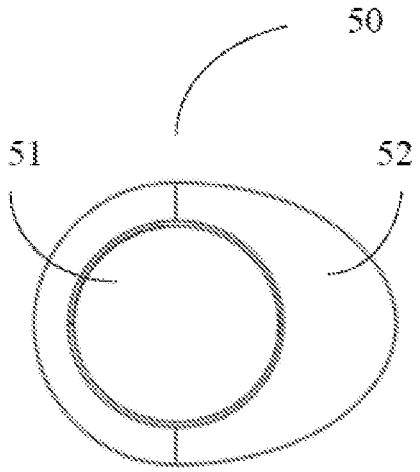
FIG. 8 is a view of an earphone cover in a second specific embodiment of the present invention.

With reference to FIG. 8, a view of the earphone cover 50 according to a second specific embodiment of the present embodiment is illustrated. In the second embodiment, the fixing portion 52 of the earphone cover 50 has a solid structure, and the sleeve portion 51 is a circular through hole penetrating the fixing portion 52. That is, the aperture of the sleeve portion 51 on the front side 523 is larger than the aperture of the sleeve portion 51 on the rear side 524.

The earphone cover provided in the present embodiment not only makes it easier to fit the ear cavity by virtue of its smooth surface, but also has more contact points with the ear cartilage, thereby achieving the effect of homogenizing pressure without puncturing the human ear cartilage.

Figure 9:
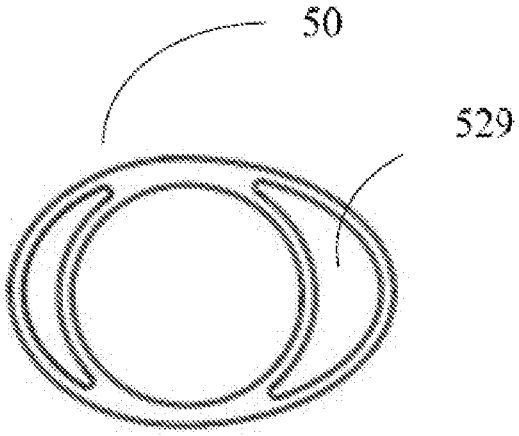
FIG. 9 is a view of an earphone cover in a third specific embodiment of the present invention.

With reference to FIG. 9, a view of the earphone cover 50 according to a third specific embodiment of the present embodiment is illustrated. In the third embodiment, the fixing portion 52 of the earphone cover 50 is further provided with at least one through hole 529. The through hole 529 has a crescent shape. Specifically, the through hole 529 is defined in the first end portion 521 and the second end portion 522 of the fixing portion 52.

Figure 10:
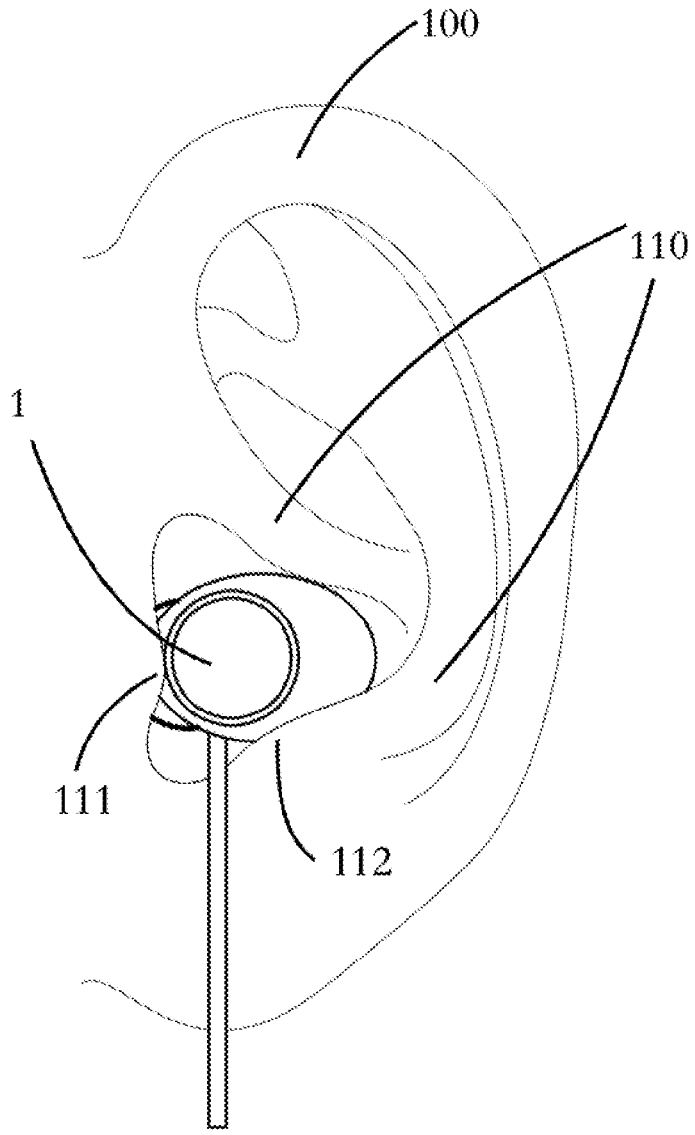
FIG. 10 is a view of the earphone in use state in a third embodiment of the present invention.

With reference to FIG. 10, a view of the earphone 1 in use state in the third embodiment is illustrated. When the earphone cover 50 abuts the ear bone 110, the first end portion 521 and the second end portion 522 are pressed by the ear bone such that the through hole 529 at the both end portions is deformed. Thus, the first end portion 521 and the second end portion 522 may not cause too much pressure on the ear bone. The earphone 1 may be fixed in the human ear without puncturing the ear bone of the human ear.

The earphone cover provided by the present embodiment is deformed when receiving the pressure, and the telescopic expansion of the earphone cover is realized by deformation.

Therefore, the earphone cover may weaken the pressure on the ear cavity caused by the earphone during use.

The foregoing is only preferred exemplary embodiments of the present invention and is not intended to be limiting of the present invention, and any modifications, equivalent substitutions, improvements and the like within the spirit and principles of the present invention are intended to be embraced by the protection range of the present invention.

We claim:

1. An earphone cover, comprising:

a sleeve portion, and a fixing portion for encasing at least a portion of an earphone, wherein:

the fixing portion encloses the sleeve portion, and the sleeve portion penetrates the fixing portion, the fixing portion comprises a first end and a second end portion opposite to the first end, when the earphone cover is placed in a human ear, the first end and the second end are in contact with an ear bone in the human ear to form at least three snapping points, the fixing portion comprises a front side facing the inside of the human ear and a rear side facing the front side, and the sleeve portion has a larger aperture on the front side than a corresponding part on the rear side such that when the earphone cover is disposed on the earphone, a gap is formed between the earphone cover and the earphone.

2. The earphone cover according to claim 1, wherein the fixing portion has an egg shape, and a spherical radius of the first end is larger than a spherical radius of the second end.

3. The earphone cover according to claim 1, wherein:

the second end comprises an upper portion corresponding to a crus helix and a lower portion corresponding to a cavitas conchae, and when the second end is snapped on an antitragus of the ear bone, the upper portion forms at least one snapping point with the crus helix, and the lower portion forms at least one snapping point with the cavitas conchae.

4. The earphone cover according to claim 1, wherein the first end is formed on a tragus of the ear bone to form at least one snapping point.

5. The earphone cover according to claim 1, wherein:

the fixing portion is provided with a cavity, and the sleeve portion is connected with the cavity, and when the fixing portion is placed into the human ear, the fixing portion is deformed to discharge air in the cavity from the sleeve portion.

6. The earphone cover according to claim 1, wherein the first end or the second end is provided with a through hole, and wherein the through hole is deformed when the first end or the second end is snapped in the ear bone.

7. The earphone cover according to claim 6, wherein the through hole has a crescent shape.

8. The earphone cover according to claim 1, wherein the fixing portion is made of silica gel.

9. A system, comprising:

an earphone; and an earphone cover, wherein the earphone cover comprises a sleeve portion, and a fixing portion for encasing at least a portion of the earphone, wherein:

the fixing portion encloses the sleeve portion, and the sleeve portion penetrates the fixing portion, the fixing portion comprises a first end and a second end opposite to the first end, when the earphone cover is placed in a human ear, the first end and the second end are in contact with an ear bone in the human ear to form at least three snapping points, the fixing portion comprises a front side facing the inside of the human ear and a rear side facing the front side, and the sleeve portion has a larger aperture on the front side than a corresponding part on the rear side such that when the earphone cover is disposed on the earphone, a gap is formed between the earphone cover and the earphone.

10. The system according to claim 9, wherein the fixing portion has an egg shape, and a spherical radius of the first end is larger than a spherical radius of the second end.

11. The system according to claim 9, wherein:

the second end comprises an upper portion corresponding to a crus helix and a lower portion corresponding to a cavitas conchae; and when the second end is snapped on an antitragus of the ear bone, the upper portion forms at least one snapping point with the crus helix, and the lower portion forms at least one snapping point with the cavitas conchae.

12. The system according to claim 9, wherein the first end is formed on a tragus of the ear bone to form at least one snapping point.

13. The system according to claim 9, wherein the fixing portion is provided with a cavity, and the sleeve portion is connected with the cavity, and when the fixing portion is placed into the human ear, the fixing portion is deformed to discharge air in the cavity from the sleeve portion.

14. The system according to claim 9, wherein:

the first end or the second end is provided with a through hole, and the through hole is deformed when the first end or the second end is snapped in the ear bone.

15. The system according to claim 14, wherein the through hole has a crescent shape.

16. The system according to claim 9, wherein the fixing portion is made of silica gel.

17. An earphone cover, comprising:

a sleeve portion, and a fixing portion for encasing at least a portion of an earphone, wherein:

the fixing portion encloses the sleeve portion, and the sleeve portion penetrates the fixing portion, the fixing portion comprises a first end and a second end opposite to the first end, when the earphone cover is placed in a human ear, the first end and the second end are in contact with an ear bone in the human ear to form at least three snapping points, the second end comprises an upper portion corresponding to a crus helix and a lower portion corresponding to a cavitas conchae, when the second end is snapped on an antitragus of the ear bone, the upper portion forms at least one snapping point with the crus helix, and the lower portion forms at least one snapping point with the cavitas conchae, the first end or the second end is provided with a through hole, and the through hole is deformed when the first end or the second end is snapped in the ear bone.

18. The earphone cover of claim 17, wherein:

the fixing portion comprises a front side facing the inside of the human ear and a rear side facing the front side, and the sleeve portion has a larger aperture on the front side than a corresponding part on the rear side such that when the earphone cover is disposed on the earphone, a gap is formed between the earphone cover and the earphone.

* * * * *